US006026774A

United States Patent [19]

Kajihara et al.

[11] Patent Number: 6,026,774

[45] Date of Patent: Feb. 22, 2000

[54] STRUCTURE FOR CONNECTING AN INTAKE TUBE TO A CYLINDER HEAD OF AN INTERNAL COMBUSTION ENGINE

[75] Inventors: Yasufumi Kajihara; Akira Shimonishi; Shigenobu Shibuya, all of Ikeda, Japan

[73] Assignee: Daihatsu Motor Co., Ltd., Osaka, Japan

[21] Appl. No.: 09/044,188

[22] Filed: Mar. 19, 1998

[30] Foreign Application Priority Data

Jun. 27, 1997 [JP] Japan ..... 9-171607

[51] Int. Cl.[7] ..... F02M 35/10

[52] U.S. Cl. ..... 123/184.21; 277/647

[58] Field of Search ..... 123/184.21; 277/647, 277/627

[56] References Cited

U.S. PATENT DOCUMENTS

| | | | |
|---|---|---|---|
| 2,081,040 | 5/1937 | King | 277/647 |
| 3,768,819 | 10/1973 | Burkert | 277/647 |
| 3,779,564 | 12/1973 | Chookazian | 277/627 |
| 3,782,343 | 1/1974 | Notaras et al. | 123/184.21 |
| 4,234,781 | 11/1980 | Flink | 277/627 |
| 4,926,813 | 5/1990 | Bonde | 123/184.21 |
| 5,235,938 | 8/1993 | Haussmann et al. | 123/184.21 |
| 5,493,954 | 2/1996 | Kostohris et al. | 277/647 |
| 5,501,075 | 3/1996 | Spies et al. | 123/184.21 |
| 5,575,247 | 11/1996 | Nakayama et al. | 123/184.21 |

FOREIGN PATENT DOCUMENTS 2-64745 5/1990 Japan .

*Primary Examiner*—John Kwon

*Attorney, Agent, or Firm*—Michael D. Bednarek; Crowell & Moring LLP

[57] ABSTRACT

A structure is provided for connecting an intake tube to an intake port of a cylinder head of an internal combustion engine. The connecting structure includes a socket end portion of the intake port, a connecting end portion of the intake tube for insertion into the socket end portion of the intake port, and a seal ring interposed between the connecting end portion of the intake tube and the socket end portion of the intake port. The seal ring has a groove which is open outwardly away from the intake port.

11 Claims, 4 Drawing Sheets

STRUCTURE FOR CONNECTING AN INTAKE TUBE TO A CYLINDER HEAD OF AN INTERNAL COMBUSTION ENGINE

BACKGROUND OF THE INVENTION

1. Field of the Invention

The present invention relates to a connecting structure for an intake tube, particularly an intake manifold, which is designed to introduce air from an air cleaner to a cylinder head of an internal combustion engine. More specifically, the present invention relates to a structure for connecting an intake tube to an intake port of a cylinder head.

2. Description of the Related Art

Conventionally, an intake manifold used as a main part of an intake apparatus has been typically made of cast iron or an aluminum alloy for attachment to a cylinder head by bolting. Recently, however, an intake manifold made of a synthetic resin material is used for realizing a reduction in cost and weight, as disclosed in JP-U-2-64745 for example.

Specifically, the prior art intake manifold disclosed in the above Japanese document includes a main tube for connection to an air cleaner, and a plurality of branch tubes each branching from the main tube for connection to a corresponding intake port of a cylinder head. For gas tightness, a seal ring having a circular cross section is fitted around a plug end portion of each branch tube for insertion into a socket end portion of the corresponding intake port together with the branch tube.

In assembly, the seal ring is compressively deformed as a whole from a circular cross section to an ellipsoidal cross section for insertion into the intake port, and the degree of such deformation must be set relatively high for providing reliable air tightness because the internal pressure within the intake port varies considerably during the engine operation. Thus, it is rather troublesome to insert the plug end portion of each branch tube into the intake port under large deformation of the seal ring. Further, the seal ring is likely to be frictionally damaged due to its insertion under large deformation.

On the other hand, the seal ring serves to prevent gas leakage not only from the exterior to the interior but also from the interior to the exterior because the internal pressure within the intake port varies between a subatmospheric level to a superatmospheric level. Thus, if the elastic deformation of the seal ring is adjusted to completely resist gas leakage from the exterior to the interior, the seal ring will also resist gas leakage from the interior to the exterior. As a result, even when the internal pressure within the intake port rises abnormally, the seal does not permit partial gas escape, so that the intake manifold and/or the air cleaner connected thereto may be broken due to an abnormal pressure rise.

SUMMARY OF THE INVENTION

It is, therefore, an object of the present invention to provide a connecting structure for an intake manifold or tube which is capable of eliminating or at least reducing the problems of the prior art described above.

According to a first aspect of the present invention, there is provided a structure for connecting an intake tube to an intake port of a cylinder head of an internal combustion engine, the connecting structure comprising: a socket end portion of the intake port; a connecting end portion of the intake tube for insertion into the socket end portion of the intake port; and a seal ring interposed between the connecting end portion of the intake tube and the socket end portion of the intake port; wherein the seal ring has a groove which is open outwardly away from the intake port.

With the connecting structure described above, when the internal pressure of the intake port is subatmospheric (i.e., below the atmospheric pressure), the external pressure (which is atmospheric) acts in the groove of the seal ring to press the seal ring against the socket end portion of the intake port and the end portion of the intake tube, respectively, thereby reliably preventing the external air from getting into the cylinder head at the time of taking in the fuel/air mixture. Conversely, when the internal pressure of the intake port is superatmospheric (i.e., above the atmospheric pressure), the groove allows the seal ring to shrink under the superatmospheric pressure in the intake port, thereby permitting a part of the internal gas to escape from the intake port when the internal pressure becomes excessively high. As a result, the intake tube together with the carburetor and the throttle body connected thereto are prevented from being unexpectedly damaged due to an excessive pressure rise within the intake port. Further, the easy deformability provided by the groove facilitates insertion of the seal ring into the intake port.

Preferably, the groove of the seal ring may have a cross section which is generally U- or V-shaped in a lying posture. Typically, the intake tube may constitute a branch tube of an intake manifold.

According to a preferred embodiment of the present invention, the seal ring includes an inner circumferential lip which is substantially cylindrical for fitting around the connecting end portion of the intake tube, and an outer circumferential lip extending obliquely at an acute angle from the inner circumferential lip for elastic contact with the socket end portion of the intake port.

According to a second aspect of the present invention, there is provided a structure for connecting an intake tube to an intake port of a cylinder head of an internal combustion engine, the connecting structure comprising: a socket end portion of the intake port; a connecting end portion of the intake tube for insertion into the socket end portion of the intake port; and a seal ring interposed between the connecting end portion of the intake tube and the socket end portion of the intake port; wherein the seal ring includes an inner circumferential lip for fitting on the connecting end portion of the intake tube, and an outer circumferential lip extending from the inner circumferential lip to progressively approach the socket end portion of the intake port into contact therewith as the outer circumferential lip extends outwardly away from the intake port.

According to a third aspect of the present invention, there is provided a structure for connecting an intake manifold to a cylinder head of an internal combustion engine, the intake manifold including a main tube and a plurality of branch tubes connected commonly to the main tube, the cylinder head including a plurality of intake ports in corresponding relation to the plurality of branch tubes of the intake manifold, the connecting structure comprising: a socket end portion of each intake port; a connecting end portion of a corresponding branch tube of the intake manifold for insertion into the socket end portion of said each intake port; and a seal ring interposed between the connecting end portion of said corresponding branch tube and the socket end portion of said each intake port; wherein the seal ring has a groove which is open outwardly away from said each intake port.

Other objects, features and advantages of the present invention will become clear from the following description of the preferred embodiment given with reference to the accompanying drawings.

DETAILED DESCRIPTION OF THE PREFERRED EMBODIMENT

Figure 1:
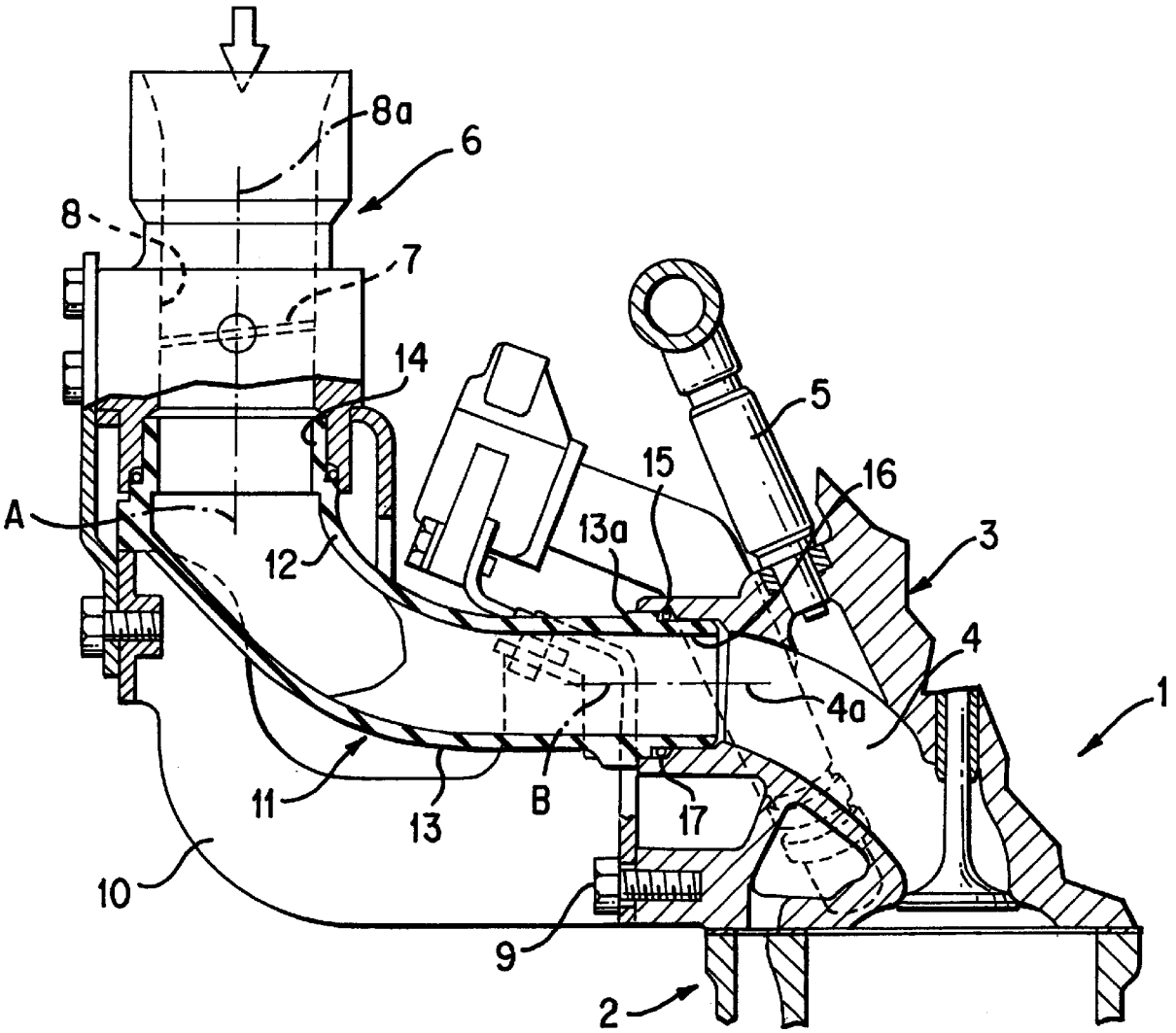
FIG. 1 is a front view, mostly in vertical section, showing a multi-cylinder internal combustion engine provided with a structure for connecting an intake manifold to a cylinder head in accordance with the present invention.
Figure 2:
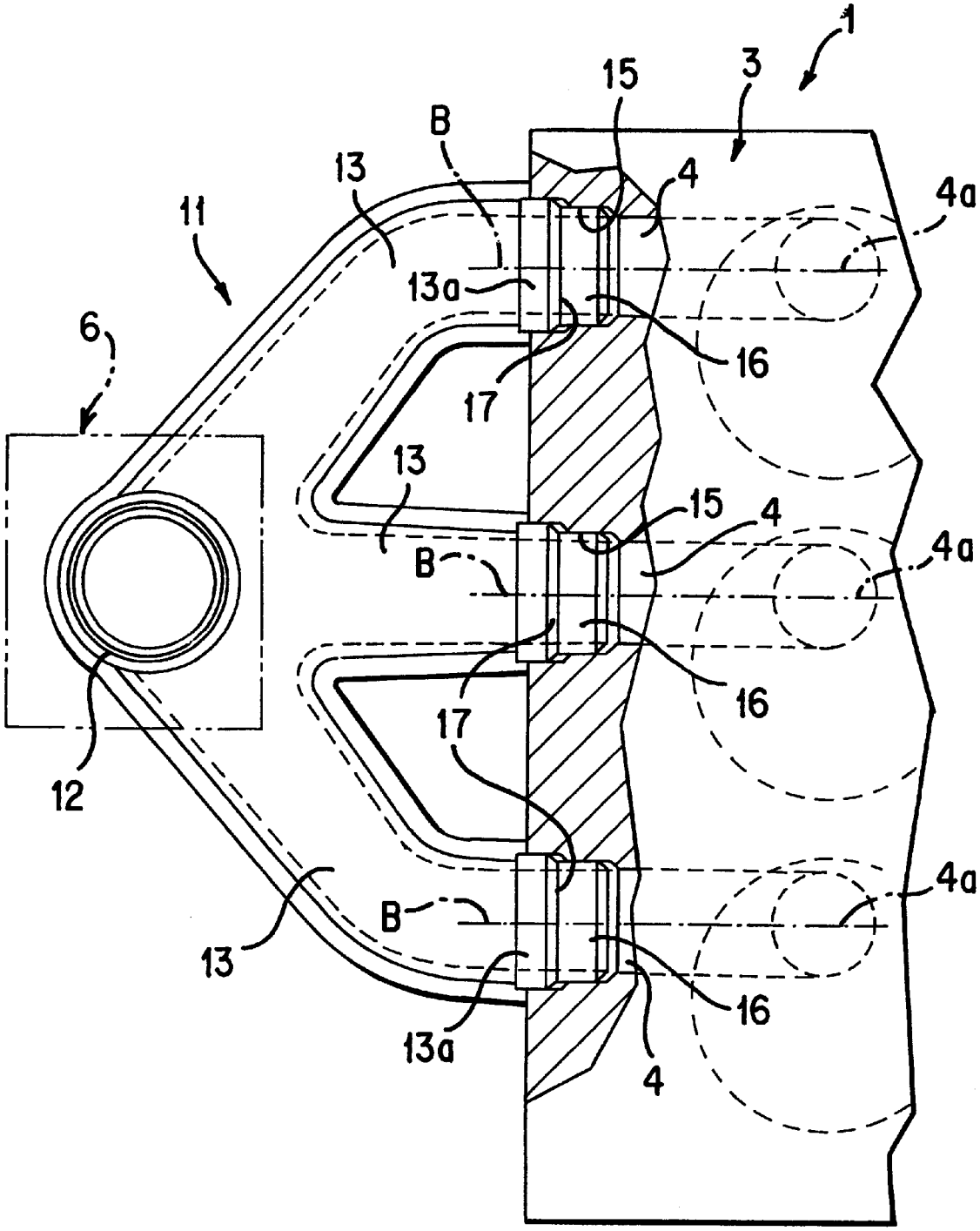
FIG. 2 is a top plan view, partially in horizontal section, of the same engine.
Figure 3:
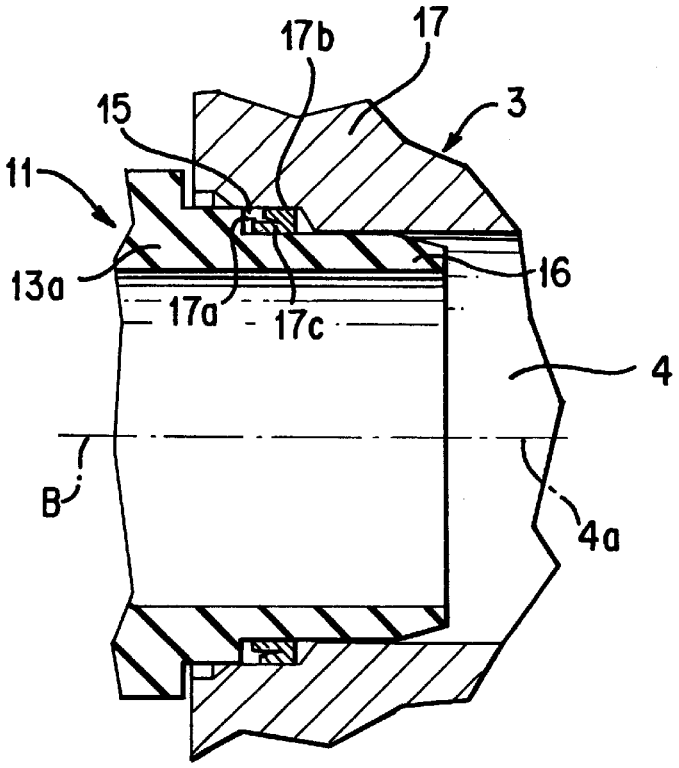
FIG. 3 is an enlarged sectional view showing the connection between each branch tube of the intake manifold and a corresponding intake port of the cylinder head.
Figure 4:
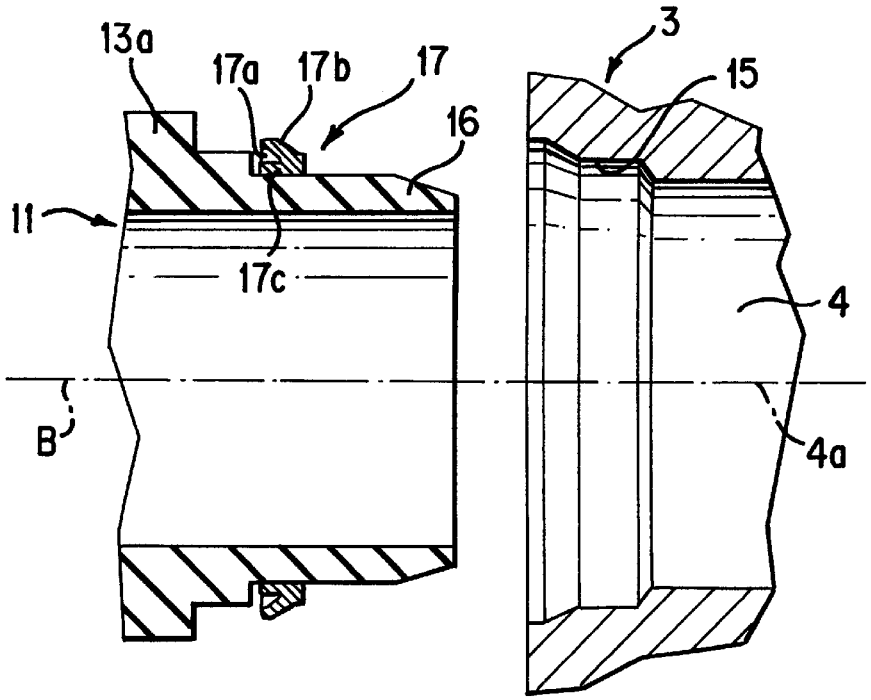
FIG. 4 is an enlarged sectional view similar to FIG. 3 but showing the state before the connection is established.
Figure 5:
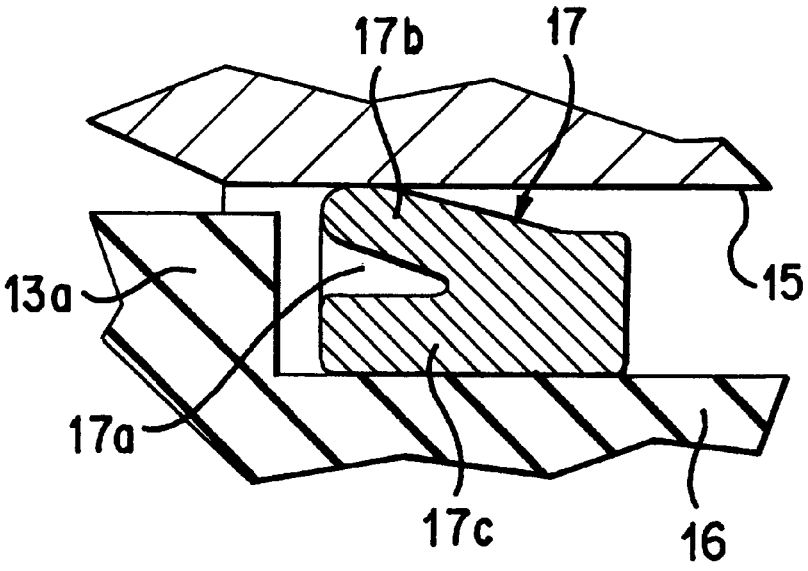
FIG. 5 is a further enlarged sectional view showing the connection between each branch tube of the intake manifold and the corresponding intake port in the same engine.
Figure 6:
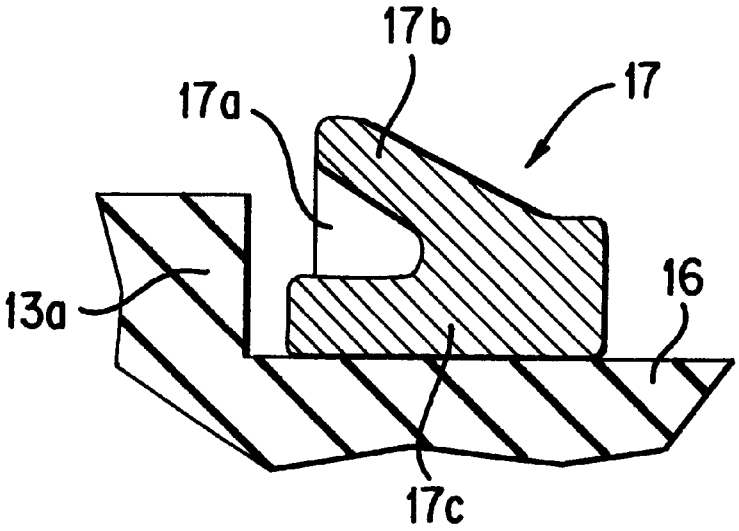
FIG. 6 is a further enlarged sectional view similar to FIG. 5 but showing the state before the connection shown in FIG. 5 is established.

FIGS. 1 and 2 show a multi-cylinder internal combustion engine which incorporates an intake manifold connected to a cylinder head in accordance with an embodiment of the present invention. In the illustrated embodiment, the engine generally represented by reference numeral 1 is of the vertical or upright cylinder type. Specifically, the engine 1 includes a cylinder block 2 having a plurality of cylinders whose bore axis extends generally vertically, i.e., perpendicularly to the horizontal plane containing the crank shaft (not shown). The engine 1 further includes a cylinder head 3 fixed on top of the cylinder block 2.

The cylinder head 3 is internally provided with a plurality of intake ports 4 in corresponding relation to the cylinders. At one side of the cylinder head 3, each intake port 4 has an outer end opening which provides a generally horizontal axis 4*a*. Further, each intake port 4 has an inner end opening which communicates with a corresponding combustion chamber at the bottom of the cylinder head 3. The cylinder head 3 is provided with a fuel injection valve 5 near the inner end opening of each intake port 4.

Reference numeral 6 designates a throttle body which has a built-in throttle valve 7. The throttle body 6 has a bore passage 8 which has a generally vertical axis 8*a* parallel to the cylinder bore axis. The throttle body 6 is removably bolted to a bracket 10 which, in turn, is attached laterally to the cylinder head 3 by bolts 9. Further, the bore passage 8 of the throttle body 6 has an upstream end which is connected to an air passage extending from an air cleaner (not shown).

An intake manifold 11 connects the throttle body 6 to the respective intake ports 4 of the cylinder head 3. Specifically, the intake manifold includes a main tube 12 and a plurality of branch tubes 13 branching from the main tube 12 toward the respective intake ports 4. The main tube 12 of the intake manifold 11 has a generally vertical axis A which substantially coincides with the bore passage axis 8*a* of the throttle body 6, whereas each branch tube 13 has a generally horizontal axis B which is substantially aligned with the horizontal axis 4*a* of the outer end opening of a corresponding intake port 4. The intake manifold 11 may be integrally formed of a heat-resistant resin (e.g. nylon-6 mixed with about 30 wt.% of glass fibers) by injection molding or blow molding.

The bore passage 8 has a socket end portion which is stepped to receive a correspondingly stepped end portion 14 of the main tube 12 of the intake manifold 11. Similarly, each intake port 4 of the cylinder head 3 has a socket end portion 15 which is stepped to receive a correspondingly stepped end portion 16 of a corresponding branch tube 13 of the intake manifold 11. For better seal, the socket end portion 15 of the branch tube 13 is externally provided with a seal ring 17 located adjacent to a diametrically enlarged portion 13*a* of the branch tube 13 which forms a part of the socket end portion 15.

According to the illustrated embodiment, the seal ring 17 is made of soft elastic rubber for example. As shown in FIGS. 3 to 6, the seal ring 17 has a lying U- or V-shape in cross section. More specifically, the seal ring 17 has an outer circumferential lip 17*b* and an inner circumferential lip 17*c* integrally connected to the outer lip 17*b* for defining a generally U- or V-shaped pressure responsive groove 17*a* which is open outwardly away from the corresponding intake port 4. In the illustrated embodiment, the inner lip 17*c* is substantially cylindrical for snugly fitting on the stepped end portion 15 of the corresponding branch tube 13 of the intake manifold 11, whereas the outer lip 17*b* extends obliquely at an acute angle from the inner lip 17*c* for elastically contacting the socket end portion 15 of the corresponding intake port 4.

In use, when the internal pressure of each intake port 4 is subatmospheric (i.e., below the atmospheric pressure), the external pressure (which is atmospheric) acts in the pressure responsive groove 17*a* of the seal ring 17 to press the outer circumferential lip 17*b* and the inner circumferential lip 17*c* against the socket end portion 15 of the intake port 4 and the stepped end portion of the corresponding branch tube 13, respectively. Thus, combined with the inherent elasticity, the seal ring 17 can reliably prevent the external air from getting into the cylinder head 3 at the time of taking in the fuel/air mixture.

On the other hand, when the internal pressure of each intake port 4 is superatmospheric (i.e., above the atmospheric pressure), the superatmospheric pressure in the intake port 4 acts to separate outer circumferential lip 17*b* and inner circumferential lip 17*c* of the seal ring 17 from the socket end portion 15 of the intake port 4 and the stepped end portion of the corresponding branch tube 13, respectively. Thus, the seal ring 17 can allows a part of the internal gas to escape from the intake port 4 when the internal pressure becomes excessively high. As a result, the intake manifold 11 together with the throttle body 6 or the carburetor (not shown) connected thereto are prevented from being unexpectedly damaged due to an excessive pressure rise within the intake port 4.

As previously described, the seal ring 17 is oriented so that the pressure responsive groove 17*a* is open outwardly of the corresponding intake port 4. Further, due to the elasticity of the seal ring 17, the outer circumferential lip 17*b* can readily deform elastically toward the inner circumferential lip 17*c*. As a result, the seal ring 17 together with the stepped end portion 16 of the corresponding branch tube 13 can be easily inserted into the socket end portion 15 of the corresponding intake port 4.

Moreover, since the inner circumferential lip 17*c* of the seal ring 17 is substantially cylindrical, the seal ring 17 can be easily and reliably fitted on the stepped end portion 16 of the corresponding branch tube 13. Further, at the time of inserting the seal ring 17 into the corresponding intake port 4, only the outer circumferential lip 17*b* of the seal ring 17 need be elastically deformed, so that such insertion is greatly facilitated.

The preferred embodiment of the present invention being thus described, it is obvious that the same may be varied in various ways. For instance, in case where a carburetor is provided in place of the throttle body 6, the main tube 12 of the intake manifold 11 is connected to the outlet end of the bore passage of the carburetor. Further, in place of the intake manifold, a plurality of intake tubes may be connected to the intake ports 4, in which case the specially configured seal ring 17 is provided around an end portion of each intake tube. Further, the seal ring 17 may be made of any elastic material other than rubber. Such variations should not be regarded as a departure from the spirit and scope of the present invention, and all such variations as would be obvious to those skilled in the art are intended to be included in the scope of the appended claims.

We claim:

1. A structure for connecting an intake tube containing internal gas to an intake port of a cylinder head of an internal combustion engine, the connecting structure comprising:

a socket end portion of the intake port;

a connecting end portion of the intake tube for insertion into the socket end portion of the intake port; and a seal ring interposed between the connecting end portion of the intake tube and the socket end portion of the intake port;

wherein the seal ring has a groove which is open outwardly away from the intake port and allowing part of the internal gas to escape.

2. The connecting structure according to claim 1, wherein the groove of the seal ring has a cross section which is generally U- or V-shaped in a lying posture.

3. The connecting structure according to claim 1, wherein the seal ring includes an inner circumferential lip which is substantially cylindrical for fitting around the connecting end portion of the intake tube, and an outer circumferential lip extending obliquely at an acute angle from the inner circumferential lip for elastic contact with the socket end portion of the intake port.

4. The connecting structure according to claim 1, wherein the intake tube forms a branch tube of an intake manifold.

5. A structure for connecting an intake tube containing internal gas to an intake port of a cylinder head of an internal combustion engine, the connecting structure comprising:

a socket end portion of the intake port;

a connecting end portion of the intake tube for insertion into the socket end portion of the intake port; and a seal ring interposed between the connecting end portion of the intake tube and the socket end portion of the intake port;

wherein the seal ring includes an inner circumferential lip for fitting on the connecting end portion of the intake tube, and an outer circumferential lip extending from the inner circumferential lip to progressively approach the socket end portion of the intake port into contact therewith as the outer circumferential lip extends outwardly away from the intake port, the seal ring allowing part of the internal gas to escape from the intake port.

6. The connecting structure according to claim 5, wherein the inner circumferential lip and outer circumferential lip of the seal ring defines a groove whose cross section is generally U- or V-shaped in a lying posture.

7. The connecting structure according to claim 5, wherein the inner circumferential lip of the seal ring is substantially cylindrical for fitting around the connecting end portion of the intake tube, the outer circumferential lip of the seal ring extending obliquely at an acute angle from the inner circumferential lip.

8. The connecting structure according to claim 5, wherein the intake tube forms a branch tube of an intake manifold.

9. A structure for connecting an intake manifold to a cylinder head of an internal combustion engine, the intake manifold including a main tube and a plurality of branch tubes connected commonly to the main tube, the cylinder head including a plurality of intake ports containing internal gas in corresponding relation to the plurality of branch tubes of the intake manifold, the connecting structure comprising;

a socket end portion of each intake port;

a connecting end portion of a corresponding branch tube of the intake manifold for insertion into the socket end portion said each intake port; and a seal ring interposed between the connecting end portion of said corresponding branch tube and the socket end portion of said each intake port;

wherein the seal ring has a groove which is open outwardly away from said each intake port for allowing part of the internal gas to escape from the intake port.

10. The connecting structure according to claim 9, wherein the groove of the seal ring has a cross section which is generally U- or V-shaped in a lying posture.

11. The connecting structure according to claim 9, wherein the seal ring includes an inner circumferetial lip which is substantially cylindrical for fitting around the connecting end portion of said corresponding branch tube, and an outer circumferential lip extending obliquely at an acute angle from the inner circumferential lip for elastic contact with the socket end portion of said each intake port.

* * * * *